US008322284B2

(12) United States Patent
Meddes et al.

(10) Patent No.: US 8,322,284 B2
(45) Date of Patent: Dec. 4, 2012

(54) PERFORATORS

(75) Inventors: Russell Vaughan Meddes, Farnborough (GB); Michael John Hinton, Farnborough (GB)

(73) Assignee: Qinetiq Limited (GB)

( * ) Notice: Subject to any disclaimer, the term of this patent is extended or adjusted under 35 U.S.C. 154(b) by 987 days.

(21) Appl. No.: 10/575,021

(22) PCT Filed: Oct. 8, 2004

(86) PCT No.: PCT/GB2004/004263

§ 371 (c)(1),
(2), (4) Date: Apr. 7, 2006

(87) PCT Pub. No.: WO2005/035929

PCT Pub. Date: Apr. 21, 2005

(65) Prior Publication Data

US 2007/0051267 A1 Mar. 8, 2007

(30) Foreign Application Priority Data

Oct. 10, 2003 (GB) ..... 0323675.9

(51) Int. Cl.
*F42B 1/02* (2006.01)

(52) U.S. Cl. ..... 102/306; 89/1.15

(58) Field of Classification Search ..... 102/476, 102/306, 307, 308, 309, 310; 89/1.15, 1.151; 175/4.55–4.59

See application file for complete search history.

(56) References Cited

U.S. PATENT DOCUMENTS

| | | | | |
|---|---|---|---|---|
| 3,650,212 | A | 3/1972 | Bauer | |
| 6,371,219 | B1 | 4/2002 | Collins et al. | |
| 6,588,344 | B2 * | 7/2003 | Clark et al. | 102/307 |
| 6,962,634 | B2 * | 11/2005 | Nielson et al. | 149/19.3 |

FOREIGN PATENT DOCUMENTS

| | | |
|---|---|---|
| DE | 3424867 | 8/1985 |
| EP | 1 241 433 | 9/2002 |
| EP | 1 348 683 | 10/2003 |
| GB | 968507 | 9/1964 |
| GB | 2 165 868 | 4/1986 |
| GB | 2 382 122 | 5/2003 |

* cited by examiner

*Primary Examiner* — James Bergin
(74) *Attorney, Agent, or Firm* — McDonnell Boehnen Hulbert & Berghoff LLP

(57) ABSTRACT

A composite material case (19) and liner (21) is described for use in a perforator (17) for completing wells such as oil, gas and water wells (1). The materials selected are intended to exhibit stability during prolonged periods at the raised temperatures and pressures present in a well (1).

24 Claims, 3 Drawing Sheets

PERFORATORS

FIELD OF THE INVENTION

The present invention relates to a perforator for use in perforating and fracturing well completions particularly, although not exclusively, perforators for use in tubing conveyed perforating guns for explosively perforating a wellbore casing, or perforating guns lowered on a slick line for perforating a tubing string or drill pipe string of wells such as, for example, oil, gas, water and steam wells.

BACKGROUND TO THE INVENTION

By far the most significant process in carrying out a completion in a cased well is that of providing a flow path between the production zone, also known as a formation, and the well bore. Typically, the creation of such a flow path is carried out using a perforator, with the resulting aperture in the casing and physical penetration into the formation via a cementing layer being commonly referred to as a perforation. Although mechanical perforating devices are known, almost overwhelmingly such perforations are formed using energetic materials e.g. high explosives. Energetic materials can also confer additional benefits in that may provide stimulation to the well in the sense that the shockwave passing into the formation can enhance the effectiveness of the perforation and produce increased flow from the formation. Typically, such a perforator will take the form of a shaped-charge. In the following, any reference to a perforator, unless otherwise qualified, should be taken to mean a shaped charge perforator.

A shaped charge is an energetic device made up of an axisymmetric case within which is inserted a liner. The liner provides one internal surface of a void, the remaining surfaces of the void being provided by the enclosure. The void is filled with a high explosive such as HMX, RDX, PYX or HNS which, when detonated, causes the liner material to collapse and be ejected from the casing in the form of a high velocity jet of material. It is this jet of material which impacts upon the well casing creating an aperture and then penetrates into the formation itself. The liner may be hemispherical but in most perforators is generally conical. The liner and energetic material are usually encased in a metallic case, conventionally the case will be steel although other alloys may be preferred. In use, as has been mentioned the liner is ejected to form a very high velocity jet which can have great penetrative power.

Generally, a large number of perforations are required in a particular region of the casing proximate a formation. To this end, a so called gun is deployed into the casing by wireline, coiled tubing or indeed any other technique know to those skilled in the art. The gun is effectively a carrier for a plurality of perforators which may be of the same or differing output. The precise type of perforator, their number and the size of the gun are a matter generally decided upon by a completion engineer based on an analysis and/or assessment of the characteristics of the completion. Depending on the nature of the formation, the aim of the completion engineer may be either to obtain the largest possible aperture in the casing or to obtain the deepest possible penetration into the surrounding formation. Thus, in an unconsolidated formation, the former will be preferred whereas in a consolidated formation the latter will be desired. It will be appreciated that the nature of a formation may vary both from completion to completion and also within the extent of a particular completion.

Typically, the actual selection of the perforator charges, their number and arrangement within a gun and indeed the type of gun is left to the completion engineer. The completion engineer will base his decision on an empirical approach born of experience and knowledge of the particular formation in which the completion is taking place. However, to assist the engineer in his selection there have been developed a range of tests and procedures for the characterisation of perforator performance. These tests and procedures have been developed by the industry via the American Petroleum Institute (API). In this regard, the API standard RP 19B (formerly RP 43 5$^{th}$ Edition) currently available for download from www.api.org is used widely by the perforator community as indication of perforator performance. Manufacturers of perforators typically utilise this API standard marketing their products. The completion engineer is therefore able to select between products of different manufacturers for a perforator having the performance he believes is required for the particular job in hand. In making his selection, the engineer can be confident of the type of performance to expect from the perforator.

Nevertheless, despite the existence of these tests and procedures there is recognition that completion engineering remains at heart more art than science. It has been recognised by the inventors in respect of the invention set out herein, that the conservative nature of the current approach to completion has failed to bring about the change in the approach to completion engineering required to enhance and increase production from both straightforward and complex completions.

SUMMARY OF THE INVENTION

Thus, in accordance with a first aspect of the invention, there is provided a component for a shaped charge perforator, the component comprising a plastics material matrix having at least one non-explosive filler embedded therein.

The component may comprise either a shaped charge liner, a shaped charge case, or both.

Preferably, the non-explosive filler is distributed homogeneously throughout the matrix. However, a non-uniform distribution of filler may be employed where this brings about a particular effect in terms of size of hole and/or depth of penetration. Such tuning of the characteristics is achieved relatively straightforwardly through controlling the introduction of the filler during manufacture of the liner. In use, it may be found effective to tune a liner so at to suit a particular formation and the nature of the desired perforation. By utilising a plastics material matrix as a case, hitherto inaccessible volumes of rapid and large scale production may be opened up. Advantageously, the plastics material matrix may be selected to have frangible if not friable characteristics. Consequently, debris from the initiation of such a perforator may be rendered substantially harmless or at least less damaging than conventionally formed cases to structures surrounding the perforator. In addition, the debris will itself be inert inasmuch as it should not facilitate or otherwise cause corrosion in other downhole components of the completion.

The shaped charge case may be reinforced, for example either by means of means of a perform or by at least one of hand laying up, filament winding, compression moulding, and braiding, or by use of individual rovings.

In a further preferred embodiment filler volume is in the range 45% to 85% of the combined volume of filler and matrix, and most preferably in the range 45% to 65% of the combined volume of filler and matrix.

In a further preferred embodiment the filler comprises particles of substantially uniform size, and especially having particles size lies in the range 10-250 nm.

The filler may be a fibre, a flake, metallic or non-metallic.

In a further preferred embodiment the ratio of filler density to matrix density is substantially unity, the e filler having, for example, a density in the range between 0.5 $gcm^{-3}$ and 5 $gcm^{-3}$.

According to a further aspect of the invention there is provided a shaped charge perforator comprising one or more components according to the first aspect of the present invention.

The shaped charge perforator may comprising a case, a liner, and a quantity of explosive packed between the case and the liner.

According to a further aspect of the invention there is provided a perforator gun comprising one or more shaped charge perforators according to the present invention.

According to a further aspect of the invention there is provided a compound for use in manufacture of components for shaped charge perforators under vacuum, the compound comprising a plastics material matrix having at least one non-explosive filler embedded therein and in which the filler volume comprises 45% to 85% of the combined volume of filler and matrix.

According to a further aspect of the invention there is provided a manufacturing method for a component for a shaped charge perforator, the method comprising compounding a matrix of plastic material with particulate filler under vacuum.

In preferred embodiments the component comprises at least one of a shaped charge liner and a shaped charge case.

In a further preferred embodiment the filler volume comprises 45% to 85% of the combined volume of filler and matrix.

In some embodiments the component comprises a first portion and a second portion, the first and second portions comprising different ratios of filler to matrix.

According to a further aspect of the invention there is provided a method of improving fluid outflow from a well borehole the method comprising perforating the borehole by means of a perforating gun according to the present invention.

Advantageously, subsequent recovery of fluids (e.g. hydrocarbons (oil or gas), water, or steam) from the well may be enhanced since use of liners and/or cases according to the present invention may provide improved penetration into the surrounding rock strata and/or mitigate the effects of debris left in the well shaft after penetration.

The fluid is typically one or more of hydrocarbons, water, and steam.

According to a further aspect of the invention there is provided a liner for a shaped charge perforator, the liner comprising a plastics material matrix having at least one non-explosive filler embedded therein, the filler being non-uniformly distributed throughout the liner whereby to tune the liner.

According to a further aspect of the invention there is provided a liner for a shaped charge perforator, the liner comprising a plastics material matrix having at least one non-explosive filler embedded therein, the liner being of non-uniform thickness whereby to tune the liner.

According to a further aspect of the invention there is provided a liner for a shaped charge perforator, the liner comprising a plastics material matrix having at least one non-explosive filler embedded therein, the filler being substantially density-matched to the plastics material.

Whilst in accordance with a yet further aspect of the invention, there is provided a manufacturing method for a shaped charge liner, the method comprising compounding a matrix of plastic material with particulate filler under vacuum. The liner may optionally include one or more of the following structures without limitation thereto, namely biconic or frills.

The various aspects of the invention may be combined both with each other and with their respective preferred features as would be apparent to the person skilled in the art.

BRIEF DESCRIPTION OF THE FIGURES

In order to assist in understanding the invention, a number of embodiments thereof will now be described, by way of example only and with reference to the accompanying drawings, in which.

DETAILED DESCRIPTION

In the following, any references to the term gun are intended to encompass the term carrier and vice versa.

Figure 1:
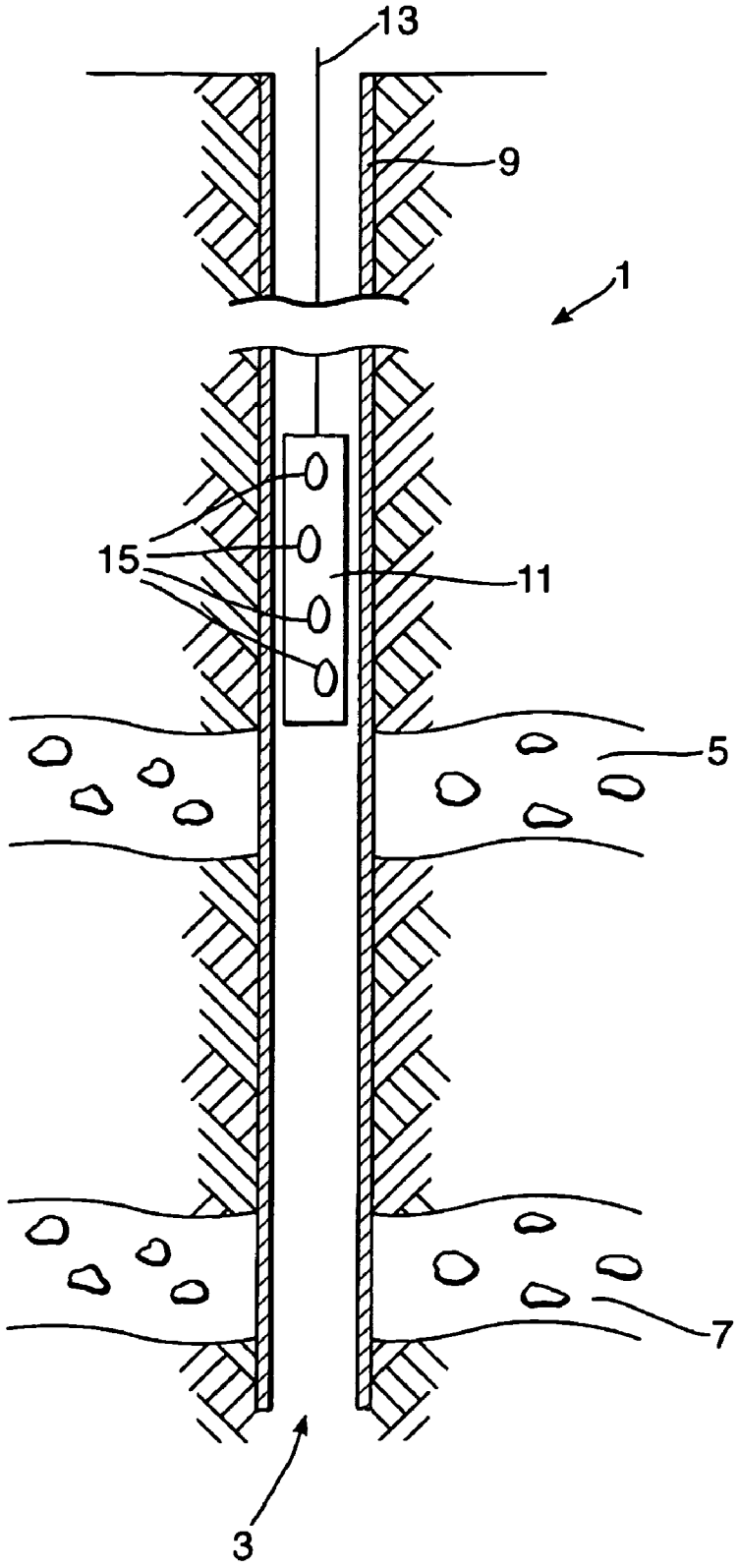
FIG. 1 is a sectional view of a completion in which a perforator according to an embodiment of the invention may be used.

With reference to FIG. 1, there is shown a stage in the completion of a well 1 in which, the well bore 3 has been drilled into a pair of producing zones 5,7 in, respectively, unconsolidated and consolidated formations. A steel tubular or casing 9 is cemented within the bore 3 and in order to provide a flow path from the production zones 5,7 into the eventual annulus that will be formed between the casing 9 and production tubing (not shown) which will be present within the completed well, it is necessary to perforate the casing 9. In order to form perforations in the casing 9, a gun 11 is lowered into the casing on a wireline, slickline or coiled tubing 13, as appropriate.

Figure 2:
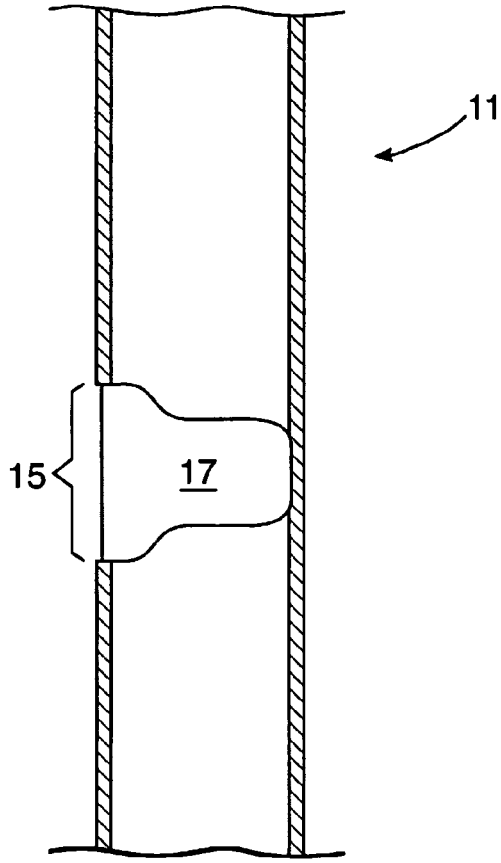
FIG. 2 is a scrap sectional view of a gun or carrier for one or more perforators of FIG. 1.

As is shown in more detail in FIG. 2, the gun 11 is a generally hollow tube of steel in this are formed ports 15 through which perforator charges 17 are fired. The diameter of the gun 11 is selected to be a close but not interference fit with the casing 9. Thus, the gun 11 is effectively self-centring within the casing 9. By having the gun 11 self-centred within the casing 9, there is little or minimal variation in the standoff distance between the charges 17 and the casing 9. Any significant variation in the standoff distance may have a detrimental effect on the consistency of performance of the perforators.

In use, the gun 11 is lowered into the well 3 to a depth where it is adjacent the production zone 5,7. It may be that the extent of the production zone 5,7 exceeds the length of a gun 11 in which case a string of guns (not shown) may be lowered and/or a number of operations may be required to fully perforate the casing in the region of each of the zones 5,7. Furthermore, it may be that where the formation is relative unconsolidated, the perforators may be selected to form a larger aperture in the casing 9 at the expense of penetration into the formation 5. Conversely, a small aperture may be formed in the casing 9 where greater penetration is required, such as, for example, in highly consolidated sediment 7. In either case, the completion engineer will attempt to select the most appropriate charges for the particular perforations required in the casing 9.

Figure 3:
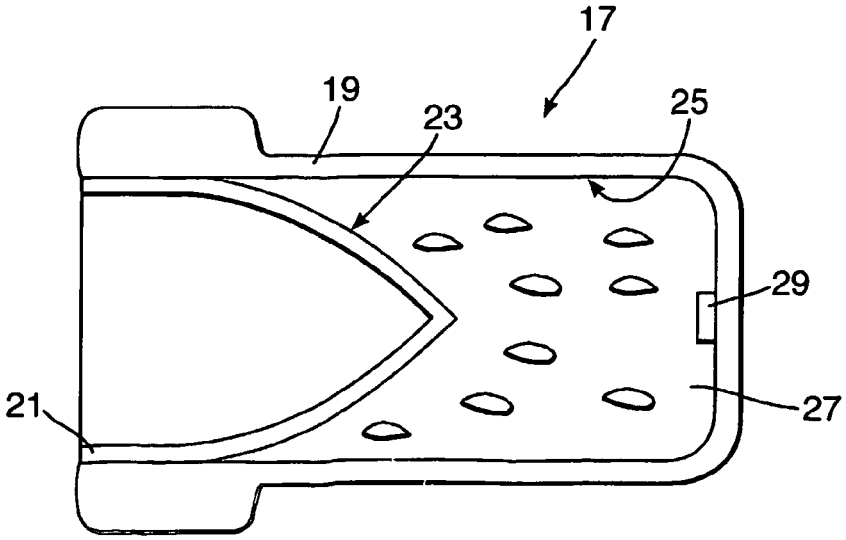
FIG. 3 is a cross-sectional view along a longitudinal axis of a perforator in accordance with an embodiment of the invention.

Turning to FIG. 3, there is shown in more detail one embodiment of a perforator 17 for use with the abovementioned gun 11. The perforator 17 is a shaped charge having a substantially cylindrical metallic case 19 and a liner 21' according to the invention of conical form and having a wall thickness of 1% to 5% of the maximum diameter of the liner. The liner 2 is intended to fit snugly in one end of the cylindrical case 19. The volume bounded by the inner surfaces 23,25 of the case and liner is filled with high explosive 27. Typical high explosives suitable for filling the perforator 17 are RDX, HMX, PYX or HNS. As has been indicated, a number of such perforators 17 are loaded into the gun 11. Each perforator 17 further includes a detonator 29 in contact with the high explosive 27.

The case 19 provides impact and environmental protection for the explosive filing 27 as well as a containment mould when filling with explosive. In addition, during assembly, the case 19 assists in ensuring correct axial alignment of the liner 21. The casing 19 is of conventional construction and as such is machined from steel selected to resist the tendency to fragment following detonation of the explosive 27. It has been found that fragmentation of the case 19 can cause collateral damage to the structures surrounding the perforator 17 including the formation 5,7 and gun 11. Furthermore, fragments of the case 19 can be carried by well fluids into valves and such like where they can lodge and/or initiate corrosion, particularly where zinc is used as a material in the composition from the case is fabricated.

In this embodiment, the liner 21 is formed from a reinforced polymeric material. Reinforcement is provided by a preform or in a variant of the embodiment using individual rovings.

The preform may be fabricated by hand lay up, filament winding, compression moulding or braiding using a binder to maintain the desired profile, to give just four examples. The selection of the most appropriate fabrication technique will, of course, depend to a large part on the scale and therefore economics of the perforator manufacture, A matrix into which a solid material loading is added, can include one or more plastics material. The plastics material will be selected from types including, but not limited to one or more of the following, namely thermosets, thermoplastics and elastomers, It will be appreciated that the selection of a plastics material is, to a great part, made on the basis of its performance at the temperatures likely to obtain with a completion. In some circumstances, a gun 11 may remain within a casing 9 for extended periods before it is used. Thus the plastics material may need to be selected to withstand not only raised temperature, perhaps 200° C. but to maintain performance at elevated temperature for a significant period of days or even weeks.

It has been determined that of the class of thermoplastics, materials such as polystyrene, polymers of olefins containing 2 to 10 carbon atoms such as polyethylene and polypropylene are suitable for selection up to temperatures of around 200° C. Around and above this temperature, plastics material having higher meting points such as polyethersulfone (PES), polyoxymethylene (POM) and PK for example, can be utilised.

Into the matrix described above is added a non-explosive filler material. The loading may be up to 80% by volume. The filler material may include one or more preferably metallic materials. For example, a metallic material may be selected from the following non-exclusive list, namely copper, aluminium, iron, tungsten and alloys thereof. Additionally or alternatively, a non-metallic material or materials may be selected. Such materials include, but are not limited to inorganic or organic materials such as borides, carbides, oxides, nitrides of metals and glasses, especially refractory metals.

It has been found that quite unexpectedly the selection of low-density fillers is not necessarily detrimental to the performance of the perforator 17. Lower density fillers are those having a density of 0.5 to around 5 g per cubic centimeter. By selecting appropriately, an approximate density match can be made between the filler and the matrix. It is thought that the approximate density match ensures that when the liner 21 is collapsed during the detonation of the high explosive 27, the filler and matrix materials are less likely to separate from each other as the liner is accelerated into a jet by the explosive 27. Furthermore, low density fillers having a density in the range of 1 to 5 g per cubic centimeter have the advantage that they lend greater bulk to the liner than higher density fillers for a given overall liner 21 weight. The filler may be a continuous or discontinuous material. By discontinuous material is meant a material whose properties vary in a piecewise constant fashion. Such materials can be modelled using a substructure approach. Alternatively, the variation in properties might be represented by an anisotropic elastic medium approximation.

The average particle or fibre diameter is in the range of around 10 nanometers to 250 microns. Above around 250 microns, in diameter, it has been found that coarse powders are more likely to separate out from the matrix during the formation of the perforator jet. Such separation results in reduced performance. At the other end of the range, it is seen that fine and ultrafine powders below about 2 microns in particle size are increasingly difficult to wet. As a result, such powders prove increasingly difficult to add to the matrix as their volume loading increases.

Although not apparent from the figure, it is possible during the formation of the lining 21, to vary the distribution of the filler material or materials over the extent of the liner 21. Such a variation in the loading permits the speed of sound within the liner 21 to be varied and thus allow the liner collapse mechanism to be tuned to suit a particular application. For example, in an unconsolidated formation, there is less need to form a so-called deep hole perforation. Rather there is a need to form a so-called big-hole perforation in the casing. The filler material may therefore be graded over the extent of the liner. Conversely, in a more consolidated formation, the creation of a deep hole perforation results in another graded distribution of filler material.

Figure 4:
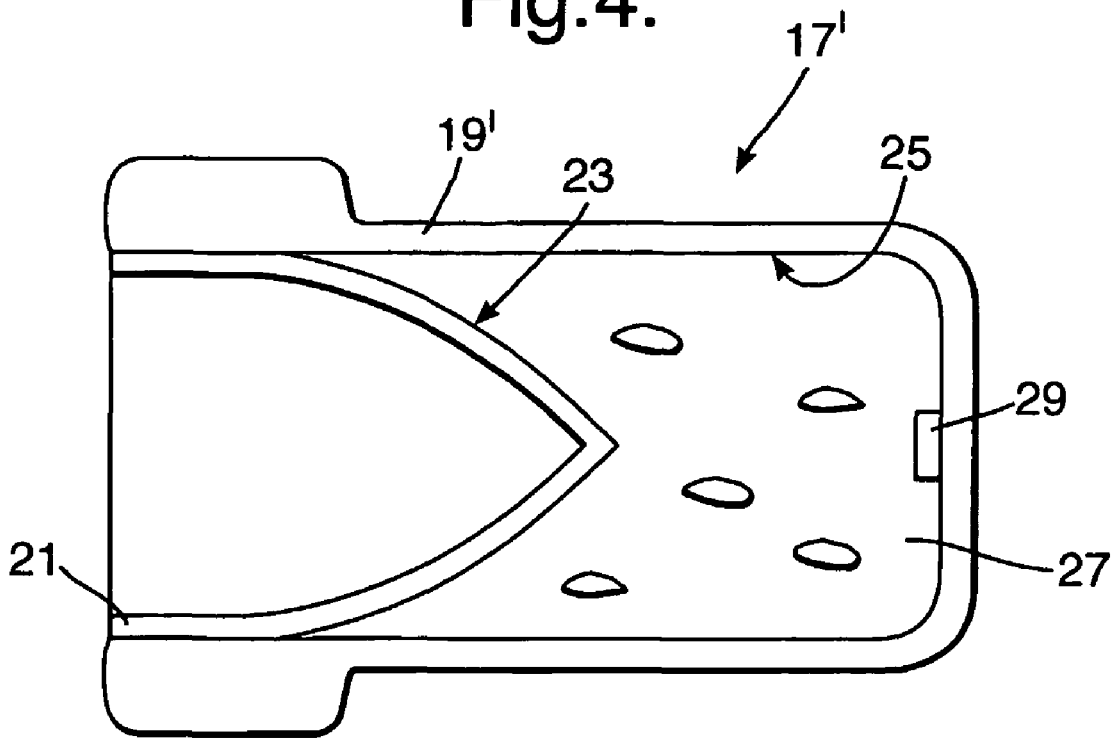
FIG. 4 is a similar view of a further embodiment of a perforator in accordance with the invention.

FIG. 4 shows a case 19' for a shaped charge perforator 17' in accordance with another embodiment of the invention. In this embodiment, the case 19' is formed from a reinforced polymeric material. Reinforcement is provided by a preform or in a variant of the embodiment using individual rovings. The same reference numbers are used in the figure to represent elements common to the previously described embodiment. For example, a reinforced polymeric liner is shown as 21.

The preform may be fabricated by hand lay up, filament winding, compression moulding or braiding using a binder to maintain the desired profile, to give just four examples. The selection of the most appropriate fabrication technique will, of course, depend to a large part on the scale and therefore economics of the perforator manufacture, A matrix into which a solid material loading is added, can include one or more plastics material. The plastics material will be selected from types including, but not limited to one or more of the following, namely thermosets, thermoplastics and elastomers, It will be appreciated that the selection of a plastics material is, to a great part, made on the basis of its performance at the temperatures likely to obtain with a completion. In some circumstances, a gun 11 may remain within a casing 9 for extended periods before it is used. Thus the plastics material may need to be selected to withstand not only raised temperature, perhaps 200° C. but to maintain performance at elevated temperature for a significant period of days or even weeks.

It has been determined that of the class of thermoplastics, materials such as polystyrene, polymers of olefins containing 2 to 10 carbon atoms such as polyethylene and polypropylene are suitable for selection up to temperatures of around 200° C. Around and above this temperature, plastics material having higher meting points such as polyethersulfone (PES), polyoxymethylene (POM) and PK for example, can be utilised.

Into the matrix described above is added a non-explosive filler material. The loading may be up to 80% by volume. The filler material may include one or more preferably metallic materials. For example, a metallic material may be selected from the following non-exclusive list, namely copper, aluminium, iron, tungsten and alloys thereof. Additionally or alternatively, a non-metallic material or materials may be selected. Such materials include, but are not limited to inorganic or organic materials such as borides, carbides, oxides, nitrides of metals and glasses, especially refractory metals.

It has been found that unexpectedly loadings of up to 80% by volume result in a case of exceptional frangibility. Preferably, the volume loading of the filler within the matrix is in the approximate range of 45 to 80% and most preferably from 45% to 65%. It has also been found that higher volume loadings result in a mixture which can be too dry for practical use in injection moulding techniques.

The filler may be a continuous or discontinuous material. By discontinuous material is meant a material whose properties vary in a piecewise constant fashion. Such materials can be modelled using a sub-structure approach. Alternatively, the variation in properties might be represented by an anisotropic elastic medium approximation.

The average particle or fibre diameter is in the range of around 10 nanometers to 250 microns. It has been found that fine or ultrafine powders below about 2 microns in particle size are increasingly difficult to wet. As a result, such powders prove increasingly difficult to add to the matrix as their volume loading increases. Indeed as particle size rises above 250 microns, it seems a case is more likely to fragment in a manner detrimental to the condition of structures surrounding and included in the gun. It is believed that the reduced particle size and lower density of the particles or fibres result in less energy being transmitted to the surrounding structures and hence a lesser potential of collateral damage.

Although not shown in FIG. 4, it is possible during the formation of the case 19', to vary the distribution of the filler material or materials over the extent of the case. Such a variation in the loading permits the speed of sound within the case 19' to be varied and thus allow the case fragmentation mechanism to be tuned to suit a particular application.

Whilst the case 19' may be used with a conventional metallic liner, it has been found to be particularly effective to utilise the case with a reinforced polymeric liner 21 such as that set out in the preceding embodiment.

It will be appreciated by those skilled in the art that a manufacturing method suitable for the embodiment of a liner 21 described above is equally suited, with the necessary changes in terms of physical geometry and perhaps grading and type of loading, for the manufacture of a case 19'. Where a case 19' and liner 21 of a perforator 17 are each formed from a reinforced polymeric material, then they may be manufactured as two separate elements, namely a liner 21 and a case 19' as distinct manufacturing operations. Alternatively, the case 19' and liner 21 may be formed in a single operation.

It should be further noted that where the case and liner are formed in a single operation, provision may need to be made to allow the introduction of the explosive.

It will be appreciated by those skilled in the art that what follows is a list of manufacturing techniques which is not intended to be exclusive. Thus, a matrix utilising a particulate reinforcement is formed by preparing a mixture of these two components and compounding them under vacuum. A case 19' and/or liner 21 of compounded thermoplastic and particulate materials can be formed using injection or compression moulding. Injection moulding is believed to be particularly suitable for a case 19' and/or liner 21 using a dry preform. Compression moulding is found to be effective for a case 19' and/or liner 21 having a preform containing thermoplastic fibres co-mingled with the reinforcement.

Where the liner 21 and/or case 19' is to be formed by filament winding, this has been found to give excellent strength and dimensional accuracy.

Finally, in a single operation moulding process where both case 19' and liner 21 are formed together, it has been found effective to utilise dissolvable cores during the moulding process. Thus, it is possible to mould a waveshaper and initiation unit substantially contemporaneously with the case 19' and liner 21. Furthermore, by incorporating multiple injection ports into the tooling, it is possible to provide the grading of loading and indeed deliver different loadings into the case 19' and/or liner 21. Thus, it is possible to tune both the penetration characteristics of the liner and the frangibility characteristics of the case 19' independently within a component formed during a single operation.

Furthermore, those skilled in the art will recognise that RIFT or RIM manufacturing techniques for example, may be employed as an alternative to injection moulding.

The invention claimed is:

1. A liner for a shaped charge perforator, the liner comprising a plastics material matrix having at least one non-explosive filler embedded therein characterized in that said liner comprises a first portion and a second portion, the first and second portions comprising different ratios of filler to matrix.

2. A liner according to claim 1 in which the filler volume is in the range 45% to 85% of the combined volume of filler and matrix.

3. A liner according to claim 1 in which the filler volume is in the range 45% to 65% of the combined volume of filler and matrix.

4. A liner according to claim 1, wherein the filler comprises particles of substantially uniform size.

5. A liner according to claim 1 in which the particles size lies in the range 10-250 nm.

6. A liner according to claim 1, wherein the filler is a fibre.

7. A liner according to claim 1, wherein the filler is a flake.

8. A liner according to claim 1, wherein the filler is a non-metallic material.

9. A liner according to claim 1, wherein the ratio of filler density to matrix density is substantially unity.

10. A liner according to claim 1 in which the filler has a density in the range between 0.5 $gcm^{-3}$ and 5 $gcm^{-3}$.

11. A liner according to claim 1 for a shaped charge perforator, the liner comprising a plastics material matrix having at least one non-explosive filler embedded therein, the filler being non-uniformly distributed throughout the liner whereby to tune the liner.

12. A liner according to claim 1 for a shaped charge perforator, the liner comprising a plastics material matrix having at least one non-explosive filler embedded therein, the liner being of non-uniform thickness whereby to tune the liner.

13. A liner according to claim 1 for a shaped charge perforator, the liner comprising a plastics material matrix having at least one non-explosive filler embedded therein, the filler being substantially density-matched to the plastics material.

14. A component according to claim 1, wherein the filler is a metallic material.

15. A liner for a shaped charge perforator, the liner comprising a plastics material matrix having at least one non-explosive filler embedded therein wherein the liner includes a non-uniform distribution of the at least one non-explosive filler such that the non-uniform distribution of filler in the matrix imparts the liner with tuned characteristics.

16. A liner for a shaped charge perforator, the liner comprising a plastics metal matric having at least one non-explosive filler embedded therein, wherein the distribution of the filler material is varied throughout the liner such that the filler material is graded over the extent of the liner.

17. A shaped charge perforator comprising a liner according to claim 1.

18. A shaped charge perforator according to claim 17 comprising a case, the liner and a quantity of explosive packed between the case and the liner.

19. A perforator gun comprising one or more shaped charge perforators according to claim 17.

20. A manufacturing method for a liner according to claim 1 for a shaped charge perforator, the method comprising compounding a matrix of plastic material with particulate filler under vacuum.

21. A method according to claim 20 in which the filler volume comprises 45% to 85% of the combined volume of filler and matrix.

22. A compound for use in manufacture of a liner according to claim 1 for shaped charge perforators under vacuum, the liner comprising a plastics material matrix having at least one non-explosive filler embedded therein and in which the filler volume comprises 45% to 85% of the combined volume of filler and matrix.

23. A method of improving fluid outflow from a well borehole the method comprising perforating the borehole by means of a perforating gun according to claim 19.

24. A method according to claim 23 in which the fluid is one or more of hydrocarbons, water, and steam.

* * * * *